US008326171B2

(12) United States Patent
Okumura

(10) Patent No.: US 8,326,171 B2
(45) Date of Patent: Dec. 4, 2012

(54) IMAGE FORMING APPARATUS AND VOLTAGE GENERATION CIRCUIT

(75) Inventor: Yasuhiko Okumura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 367 days.

(21) Appl. No.: 12/796,951

(22) Filed: Jun. 9, 2010

(65) Prior Publication Data

US 2011/0020028 A1 Jan. 27, 2011

(30) Foreign Application Priority Data

Jul. 23, 2009 (JP) ..... 2009-172568

(51) Int. Cl.
*G03G 15/00* (2006.01)

(52) U.S. Cl. ..... 399/88

(58) Field of Classification Search ..... 399/55, 399/88, 270, 285; 323/223, 355; 307/17
See application file for complete search history.

(56) References Cited

U.S. PATENT DOCUMENTS 4,727,463 A * 2/1988 Suzuki ..... 363/21.17
6,882,806 B2 * 4/2005 Sunahara et al. ..... 399/50
2004/0218939 A1 * 11/2004 Motohashi et al. ..... 399/50
2005/0271406 A1 * 12/2005 Okano et al. ..... 399/50
2006/0120743 A1 * 6/2006 Motohashi et al. ..... 399/50
2009/0028593 A1 1/2009 Okumura

FOREIGN PATENT DOCUMENTS

JP 01089196 A * 4/1989
JP 01308128 A * 12/1989
JP 2009-33815 A 2/2009

* cited by examiner

*Primary Examiner* — Robert Beatty
(74) *Attorney, Agent, or Firm* — Fitzpatrick, Cella, Harper & Scinto

(57) ABSTRACT

An image forming apparatus includes a developing device configured to perform development and a voltage generation circuit configured to apply a developing bias voltage to the developing device. Here, the voltage generation circuit includes a transformer configured to generate an alternating voltage to be applied as the developing bias voltage on a secondary winding; a capacitor that is connected to a first end of a primary winding of the transformer; a first voltage generating unit that is connected to a second end of the primary winding and is configured to generate a first voltage; a second voltage generating unit that is connected to the first end via the capacitor and is configured to generate a second voltage; and a controller configured to perform control so as to store an electric charge in the capacitor with the first voltage and the second voltage before the alternating voltage is generated.

7 Claims, 7 Drawing Sheets

IMAGE FORMING APPARATUS AND VOLTAGE GENERATION CIRCUIT

BACKGROUND OF THE INVENTION

1. Field of the Invention

The present invention relates to an image forming apparatus and a voltage generation circuit.

2. Description of the Related Art

Image forming apparatuses are known that employ an electrophotographic method or an electrostatic recording method. Such apparatuses use a one-component developer mainly composed of a magnetic toner or a two-component developer mainly composed of a non-magnetic toner and a magnetic carrier for a developing process. In particular, many image forming apparatuses that form a full color image or a multicolor image by the electrophotographic method use the two-component developer in view of the color quality and the like of images.

In the above-described developing process, a developing device develops an electrostatic latent image formed on an image carrier by use of a developer. At this time, a high voltage in which an alternating voltage is superimposed on a direct voltage is applied to the developing device.

If a high voltage is applied to a development gap (a gap between the image carrier (a photosensitive member) and the developing device (a developing sleeve)), a ring-like or a spot-like pattern as shown in FIGS. 6A and 6B may appear in a formed toner image (hereinafter referred to as a ring mark). FIG. 6A shows a ring mark that appears in a background portion, and FIG. 6B shows a ring mark that appears in an image portion. The occurrence of such a ring mark considerably impairs the image quality.

Here, a mechanism of occurrence of a ring mark will be described. As an image forming process is repeatedly performed in an image forming apparatus, the surface of the developing sleeve is scraped by the carrier or the like, or metal powder from a metal screw or the like intrudes into a developing device. If metal foreign matter intrudes into the developing device, the development gap narrows, and consequently, a discharge occurs between the metal foreign matter and the surface of the image carrier. The occurrence of a ring mark is due to this discharge phenomenon.

In light of the principle of occurrence of a ring mark as described above, a technique of inhibiting a ring mark that appears in the background portion by decreasing a positive voltage Vp+ of a developing alternating voltage shown in FIG. 7 is known. FIG. 7 shows an example of the surface potentials of the developing device and the image carrier and an outline of developer movement. Vdark indicates the surface potential of a region of the image carrier that has been uniformly charged by a charger and has not been exposed by an exposure unit (i.e., that is not to be developed). Vlight indicates the potential of a latent image formed on the image carrier by exposure. Vdc indicates a direct potential applied to the developing sleeve (the developing device) by a developing DC generator, and Vp+ and Vp− indicate amplitude values of an alternating voltage applied to the developing sleeve by a developing AC generator.

Here, the magnitude of a potential difference Vcontrast between Vdc and Vlight influences a development density, that is, the density of a visible image. Moreover, a potential difference Vback between Vdark and Vdc is a potential difference for preventing an unexposed portion from being developed (so-called fogging prevention). Decreasing Vp+ decreases the potential difference between Vdark and Vp+ and can result in a ring mark reduction.

Moreover, if a latent image of a high-density region and a latent image of a low-density region are adjacent to each other on the image carrier, a developer that should stick to the low-density region is attracted to the latent image of the high-density region. Consequently, a region that originally has to be developed fails to be developed, and a phenomenon in which an image is missing (hereinafter referred to as a white spot) may occur.

Here, it is known that at a large absolute value of Vp−, the potential difference between Vp− and Vlight is large, and the developability is improved even with respect to the latent image of the low-density region. Moreover, if an alternating voltage is applied to the developing sleeve, an electric field Vp− in a direction in which the developer is allowed to fly from the developing sleeve to the photosensitive member and an electric field Vp+ in a direction in which the developer is returned from the photosensitive member to the developing sleeve are alternately produced, so that the developer is oscillated so as not to cause a development unevenness. Therefore, the application of an alternating voltage is effective in rendering the development density uniform.

Moreover, a technique of using an asymmetric duty cycle blank pulse waveform when applying a voltage to the developing device as described above has been proposed. With this waveform, the time for which a positive voltage Vp+ is output and the time for which a negative voltage Vp− is output can be made different from each other. Moreover, the absolute value of Vp+ can be smaller than the absolute value of Vp−, and even a blank period can be set. Thus, demerits of the use of an alternating voltage can be suppressed while utilizing the above-described merits of a high alternating voltage (see Japanese Patent Laid-Open No. 2009-33815).

In applying a voltage to the developing device, especially in an operation sequence when starting output, a transformer provided in a high voltage generation circuit for generating the voltage to be applied may reach magnetic saturation. Magnetic saturation of a transformer means that the magnetic permeability of a core is 1, and occurs when the magnetic flux density in the transformer core exceeds a saturation magnetic flux density, which depends on the shape, material, and number of turns of the core. If the transformer reaches magnetic saturation, the inductance rapidly decreases, so that a large current flows through the transformer, leading to damage to the circuit. The magnetic flux density in the core is proportional to a current flowing through a coil of the transformer.

Here, the current is expressed as follows:

$I=\int V/L\,dt$ V: voltage, L: inductance

That is to say, the magnetic flux density is proportional to the product (VT product) of the voltage input to the transformer and the time. Accordingly, for example, in order to prevent magnetic saturation due to an increased VT product, it is necessary to increase the number of turns of the transformer, increase the core size, change the core to a core material having a high saturation magnetic flux density, or take other measures. All of such measures involve an increase in the cost of the transformer.

SUMMARY OF THE INVENTION

The present invention provides technology whereby the maximum value of the magnetic flux density of the transformer is suppressed to a small value during generation of a developing bias voltage in which an alternating voltage is superimposed on a direct voltage.

According to a first aspect of the present invention, there is provided an image forming apparatus, comprising: a developing device configured to perform development by sticking a developer to an electrostatic latent image formed on a surface of an image carrier; and a voltage generation circuit configured to apply a developing bias voltage in which a direct voltage is superimposed on an alternating voltage to the developing device, wherein the voltage generation circuit comprises: a transformer configured to generate the alternating voltage to be applied as the developing bias voltage on a secondary winding by an effect of a primary winding; a capacitor that is connected to a first end of the primary winding of the transformer; a first voltage generating unit that is connected to a second end of the primary winding of the transformer different from the first end and is configured to generate a first voltage; a second voltage generating unit that is connected to the first end of the primary winding of the transformer via the capacitor and is configured to generate a second voltage having a voltage value different from the first voltage; and a controller configured to perform control so as to store an electric charge in the capacitor with the first voltage and the second voltage before the alternating voltage is generated by the effect of the primary winding of the transformer.

According to a second aspect of the present invention, there is provided a voltage generation circuit configured to apply a developing bias voltage in which a direct voltage is superimposed on an alternating voltage to a developing device configured to perform development by sticking a developer to an electrostatic latent image formed on a surface of an image carrier, the circuit comprising: a transformer configured to generate the alternating voltage to be applied as the developing bias voltage on a second winding by an effect of a primary winding; a capacitor that is connected to a first end of the primary winding of the transformer; a first voltage generating unit that is connected to a second end of the primary winding of the transformer different from the first end and is configured to generate a first voltage; a second voltage generating unit that is connected to the first end of the primary winding of the transformer via the capacitor and is configured to generate a second voltage having a voltage value different from the first voltage; and a controller configured to perform control so as to store an electric charge in the capacitor with the first voltage and the second voltage before the alternating voltage is generated by the effect of the primary winding of the transformer.

Further features of the present invention will be apparent from the following description of an exemplary embodiment with reference to the attached drawings.

DESCRIPTION OF THE EMBODIMENT

An exemplary embodiment of the present invention will now be described in detail with reference to the drawings. It should be noted that the relative arrangement of the components, the numerical expressions and numerical values set forth in this embodiment do not limit the scope of the present invention unless it is specifically stated otherwise.

It should be noted that in this embodiment, an image forming apparatus that supports four colors, Y, M, C, and Bk, and that forms an image using the electrophotographic method will be described as an example. However, this is not a limitation, and the image forming apparatus may support, for example, six colors, or may support only monochrome.

Moreover, a printing medium includes not only paper such as a sheet of paper but also a wide range of media, such as cloth, plastic films, metal plates, glass, ceramic, wood, and leather, that can accept a developer such as a toner.

Figure 1:
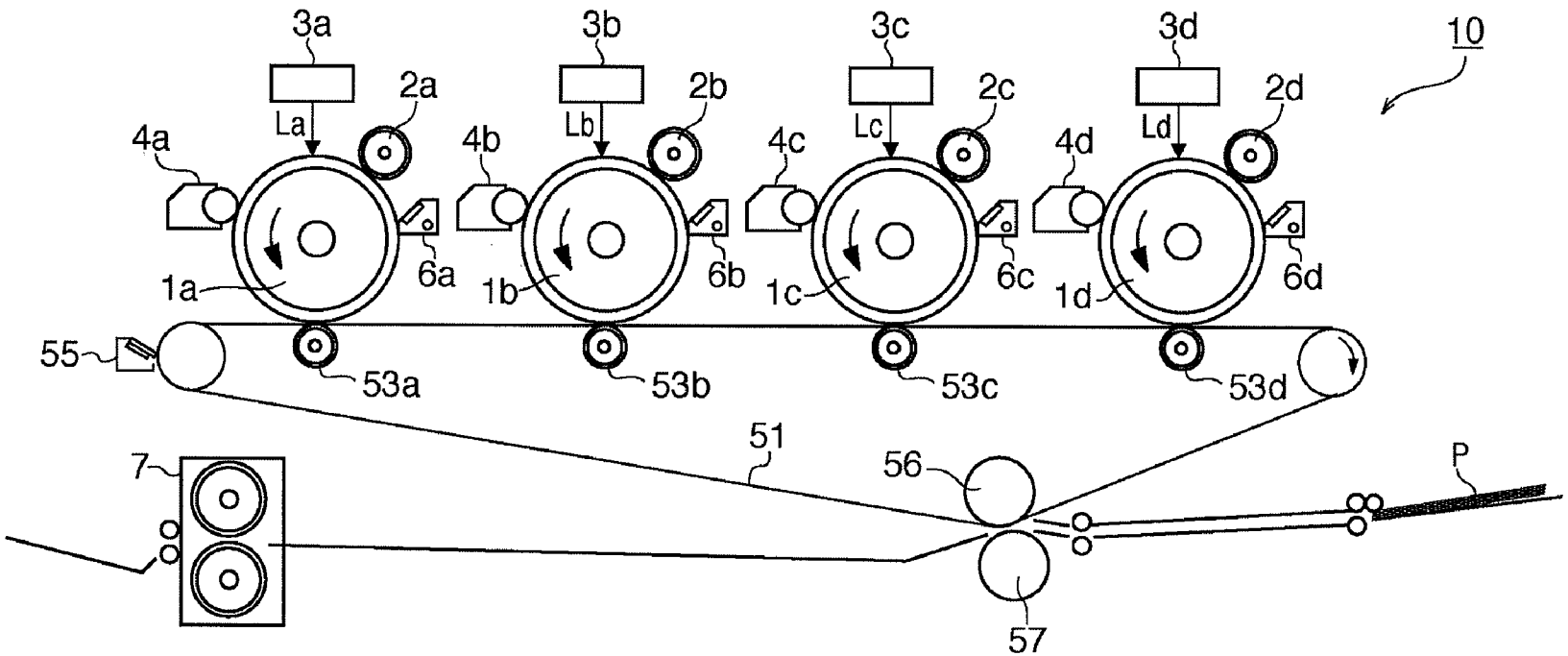
FIG. 1 is a diagram showing an example of the configuration of an image forming system of an image forming apparatus 10 according to an embodiment of the present invention.

FIG. 1 is a diagram showing an example of the configuration of an image forming system of an image forming apparatus 10 according to an embodiment of the present invention.

The image forming apparatus has four image forming stations for yellow, magenta, cyan, and black. It should be noted that the letters a to d added to the end of numerals of the reference symbols correspond to image forming units for yellow, magenta, cyan, and black, respectively. In the following description, the letters a to d will be omitted.

The image forming apparatus includes a photosensitive member 1, a primary charger 2, an exposure unit 3, a developing device 4, a primary transfer roller 53, a cleaner 6, an intermediate transfer belt 51, an intermediate transfer belt cleaner 55, and secondary transfer rollers 56 and 57.

Here, the photosensitive member 1 functions as an image carrier. The photosensitive member 1 is uniformly charged to a predetermined polarity and potential by the effect of a high charging voltage applied by the primary charger (primary charging roller) 2.

The exposure unit 3 exposes the uniformly charged photosensitive member 1 according to an image signal. Thus, for example, an electrostatic latent image corresponding to each color component image (e.g., yellow, magenta, cyan, or black) is formed on the photosensitive member 1.

The developing device 4 sticks the developer (e.g., a toner) to the electrostatic latent image formed on the photosensitive member 1. Thus, the developer is developed onto the photosensitive member 1.

The primary transfer roller (primary transfer unit) 53 is disposed in a position opposite from the photosensitive member 1 with the intermediate transfer belt 51 sandwiched between them. The electrostatic latent image on the photosensitive member 1 is transferred onto the intermediate transfer belt 51 by the effect of static electricity applied to the primary transfer roller 53. The image on the intermediate transfer belt 51 transferred from the photosensitive member 1 is transferred onto a printing medium (e.g., a sheet of paper). Thus, an image is formed on the sheet of paper.

Here, an example of the flow of image formation performed in the image forming apparatus 10 shown in FIG. 1 will be briefly described.

First, the primary charger 2 uniformly charges the photosensitive member 1. Then, the exposure unit 3 exposes the photosensitive member 1 according to an image signal. Thus, an electrostatic latent image is formed on the surface of the photosensitive member 1. Afterwards, the developing device 4 sticks the developer to the electrostatic latent image formed on the photosensitive member 1.

Once a toner image is developed on the photosensitive member 1, the toner images on the four photosensitive members 1 are transferred onto the intermediate transfer belt 51 one on top of the other by the primary transfer roller and then transferred onto the printing medium P by the secondary transfer roller. The toner that has not been transferred onto the intermediate transfer belt 51 and remains on the photosensitive member 1 is collected by the cleaner 6, and the toner that has not been transferred onto the printing medium P and remains on the intermediate transfer belt 51 is collected by the intermediate transfer belt cleaner 55. The toner images transferred onto the printing medium P are fixed by a fixing unit 7. A color image is thus formed on the printing medium P.

Figure 2:
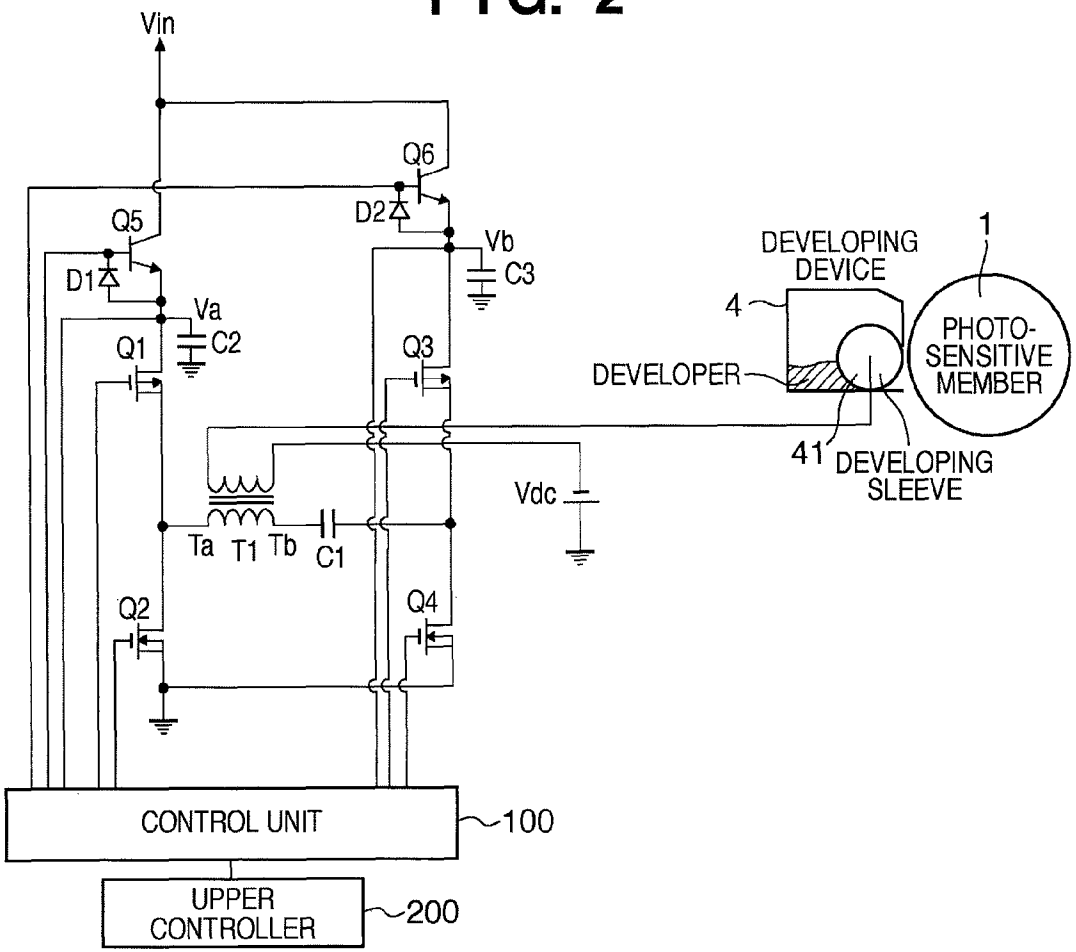
FIG. 2 is a diagram showing an example of a schematic configuration of a developing alternating voltage generation circuit.

FIG. 2 is a diagram showing an example of a schematic configuration of a developing alternating voltage generation circuit provided in the image forming apparatus 10 shown in FIG. 1. It should be noted that the developing alternating voltage generation circuit is a circuit for generating an alternating voltage during generation of a developing bias voltage, in which the alternating voltage is superimposed on a direct voltage.

A driving power supply Vin supplies a voltage (e.g., 24 V) to the developing alternating voltage generation circuit. The developing alternating voltage generation circuit is provided with an input unit (not shown) for input of the driving power supply. Switching elements Q1, Q2, Q3, and Q4 each function as an electronic switch constituting a so-called full bridge circuit that has a primary winding of a transformer T1 and a capacitor C1 as its loads. For example, an FET can be used as each of the switching elements.

The capacitor C1 is connected to a Tb end of the primary side (hereinafter referred to as the primary winding) of the transformer T1 and absorbs an imbalance between positive and negative voltages of the alternating voltage. The switching element Q1, which functions as a first switching unit, is connected between a Ta end of the primary winding of the transformer T1 and a first voltage generating unit (described later) and turns this connection to a connected state (on) or an unconnected state (off). For example, the switching element Q1 turns on/off a voltage applied to the Ta end of the transformer. The switching element Q2, which functions as a second switching unit, is connected between the Ta end of the primary winding of the transformer T1 and the ground (GND) and turns on/off this connection. For example, the switching element Q2 switches the potential at the Ta end of the primary winding of the transformer T1 to a reference potential (ground potential).

The switching element Q3, which functions as a third switching unit, is connected between the capacitor C1 and a second voltage generating unit (described later) and turns on/off this connection. For example, the switching element Q3 turns on/off a voltage applied to the Tb end of the transformer via the capacitor C1. The switching element Q4, which functions as a fourth switching unit, is connected between the capacitor C1 and the ground (GND) and turns on/off this connection. For example, the switching element Q4 switches the potential at the Tb end of the primary winding of the transformer T1 to the reference potential (ground potential).

A transistor Q5 functions as a first voltage control element, and a transistor Q6 functions as a second voltage control element. The transistor Q5 is driven in order to control a voltage Va applied from the driving power supply Vin to the switching element Q1 to a desired value. The transistor Q6 is driven in order to control a voltage Vb applied from the driving power supply Vin to the switching element Q2 to a desired value. It should be noted that the voltages Va and Vb have different voltage values. The switching elements Q1 and Q2 are driven in regions where they have linear output characteristics.

Capacitors C2 and C3 and diodes D1 and D2 are individually provided between base and emitter of the transistors Q5 and Q6. Here, Q5, C2, and D1 constitute the first voltage generating unit for generating the voltage Va. Also, Q6, C3, and D2 constitute the second voltage generating unit for generating the voltage Vb. It should be noted that the first voltage generating unit and the second voltage generating unit may not necessarily be configured using a transistor, a diode, and a capacitor as long as the control unit 100 can control rising timings of the voltages Va and Vb.

One end of a secondary side (hereinafter referred to as a secondary winding) of the transformer T1 is connected to the developing sleeve 41, which serves as a load, and the other end is connected to a developing direct voltage generation circuit Vdc. Due to the effect of the primary winding of the transformer T1, an alternating voltage is generated on the secondary winding of the transformer T1. With this configuration, a high voltage in which a direct voltage and an alternating voltage are superimposed on each other is applied to the developing sleeve 41 as the developing bias voltage.

The developing sleeve 41 includes, for example, a toner and a carrier. The developing sleeve 41 rotates with a developer carried thereon and sticks the toner onto the photosensitive member 1 using a potential difference between an electrostatic latent image formed on the photosensitive member 1 and the toner. Development is thus performed.

An upper controller 200 is configured of, for example, a CPU and conducts overall control of the image forming apparatus 10. The upper controller 200, for example, receives an instruction or the like from a user via an operator panel (not shown) and controls the operation of each unit based on the instruction.

The control unit 100 controls on-off of the switching elements Q1 to Q4 and base voltages of the transistors Q5 and Q6 independently. This control is performed based on command values (command values of the voltages Vp+ and Vp− applied to the developing sleeve 41) provided from the upper controller 200.

With respect to the provided command values (Vp+ and Vp−), the control unit 100 controls the base voltage of the transistor Q5 so that Va that satisfies $n2 \times Va = n1 \times |Vp-|$ is the potential of the capacitor C2. Here, n1 indicates the number of turns of the primary winding of the transformer T1, and n2 indicates the number of turns of the secondary winding of the transformer T1. The control unit 100 controls the base voltage of the transistor Q6 so that Vb that satisfies $n2 \times Vb = n1 \times Vp+$ is the potential of the capacitor C3 as in the case of control of the base voltage of the transistor Q5.

Figure 3:
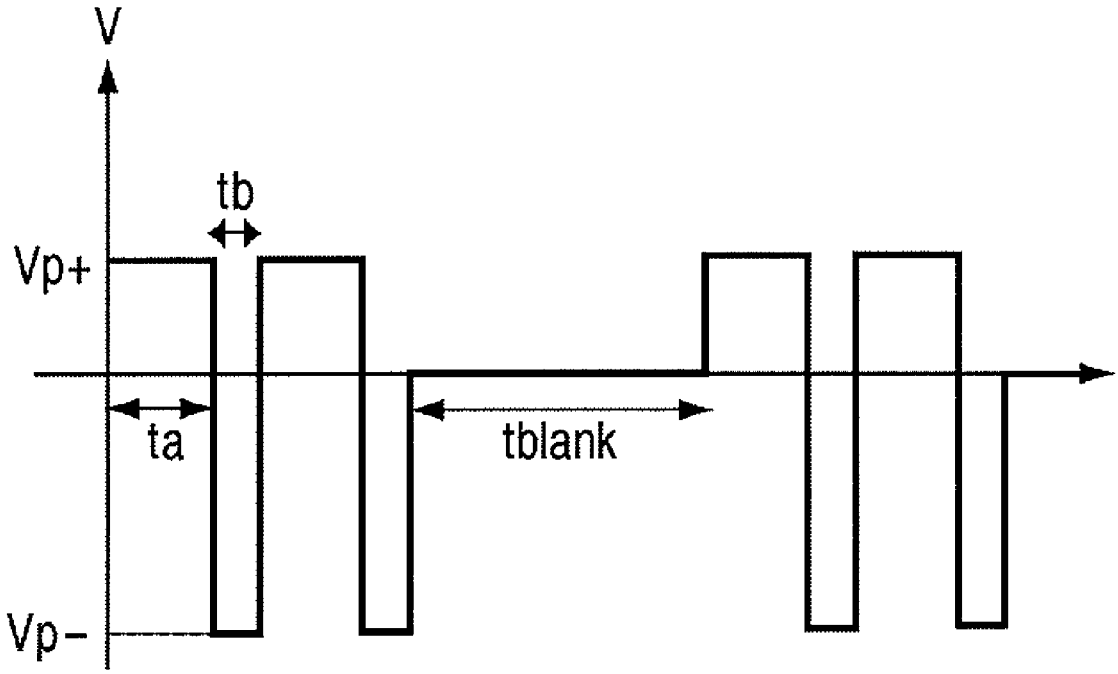
FIG. 3 is a diagram showing an example of an asymmetric duty cycle blank pulse waveform.

Moreover, as shown in FIG. 3, with respect to a predetermined cycle t (=ta+tb) of the alternating voltage, the control unit 100 derives ta and tb that satisfy $Vp+:|Vp-|=tb:ta$. The control unit 100 obtains the periods ta and tb that render the ratio between absolute values of the voltage Va and the voltage Vb equal to the ratio between the period ta and the period tb. During the period ta, the voltage Va is applied to the Ta end of the primary winding of the transformer T1, and during the period tb, the voltage Vb is applied to the Tb end of the primary winding of the transformer T1. It should be noted that control units 100 may be provided corresponding to the developing devices 4 for respective colors and each developing device 4 operated independently, or a common control unit 100 may be provided for a plurality of developing devices.

Figure 4:
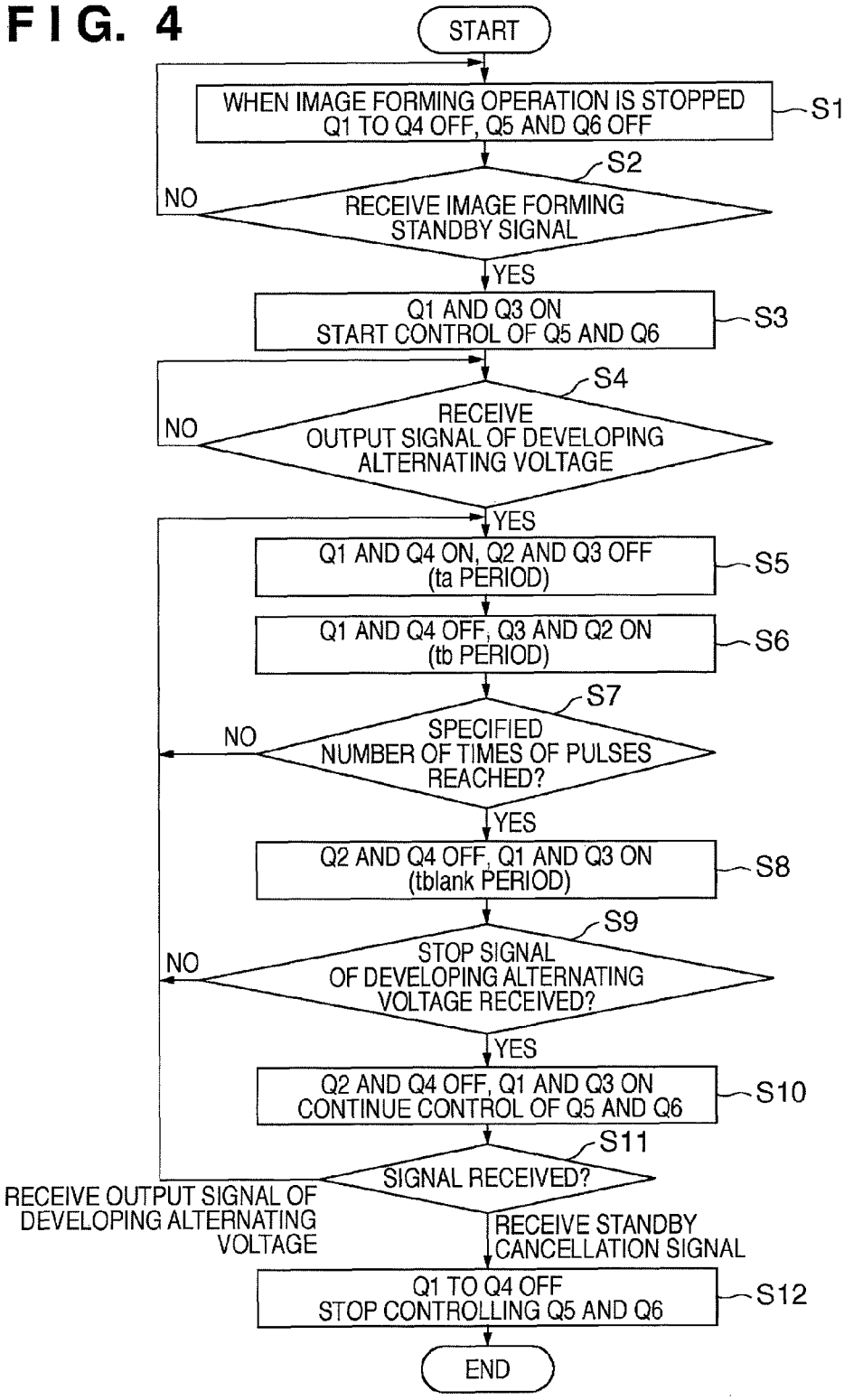
FIG. 4 is a flowchart showing an example of the operation of a control unit 100.

FIG. 4 is a flowchart showing an example of the operation of the control unit 100 shown in FIG. 2.

When the image forming apparatus 10 is stopped, that is, when the image forming apparatus 10 is not performing image formation, the control unit 100 performs control so as to turn off the switching elements Q1 to Q4 and the transistors Q5 and Q6 (step S1). The upper controller 200 outputs an image forming standby signal to the control unit 100 upon receipt of an instruction from the user.

The control unit 100 is in a state in which it waits to receive an image forming standby signal (NO in step S2). Here, upon receipt of this signal (YES in step S2), the control unit 100 turns on gates of the switching elements Q1 and Q3 (step S3). At this time, the control unit 100 also starts to control the first voltage generating unit and the second voltage generating unit (the transistors Q5 and Q6). Specifically, the control unit 100 performs control so that the voltage Va generated by the first voltage generating unit, which includes Q5, C2, and D1, becomes a predetermined constant voltage and the voltage Vb generated by the second voltage generating unit, which includes Q6, C3, and D2, becomes a predetermined constant voltage. Although this control desirably is performed by starting to control the transistors Q5 and Q6 after turning on the switching elements Q1 and Q3, the control of the transistors Q5 and Q6 may be started first, or the control of both the switching elements and the transistors may be performed at the same time.

The upper controller 200 outputs an output signal of the developing alternating voltage to the control unit 100 in coordination with the timing of development of a development image on the photosensitive member 1 onto a predetermined position of the printing medium P via the intermediate transfer belt 51. It should be noted that during a period from the output of the image forming standby signal to the output of the output signal, the first voltage generating unit and the second voltage generating unit continue to output the stable voltages Va and Vb, respectively. A potential of Va−Vb is stored in the capacitor C1.

Here, the control unit 100 is in a state in which it waits to receive an output signal of the developing alternating voltage (NO in step S4). Upon receipt of this output signal (YES in step S4), the control unit 100 provides an ON signal to the gates of the switching elements Q1 and Q4 and also provides an OFF signal to the gates of the switching elements Q2 and Q3 (step S5). This establishes an electrical connection between the switching elements Q1 and Q4 during the ta period (first control period). At this time, a voltage, Va−(Va−Vb)=Vb, is obtained as a potential difference across the primary winding of the transformer T1. Thus, a voltage based on that potential difference is generated as an alternating voltage on the secondary winding side of the transformer T1.

After the ta period has elapsed, the control unit 100 provides an OFF signal to the gates of the switching elements Q1 and Q4 and also provides an ON signal to the gates of the switching elements Q2 and Q3 (step S6). This establishes an electrical connection between the switching elements Q2 and Q3 during the tb period (second control period). At this time, a voltage, Vb−(Vb−Va)=Va, is obtained as a potential difference across the primary winding of the transformer T1. A voltage based on that potential difference is generated as an alternating voltage on the secondary winding side of the transformer T1. Thus, the developing alternating voltage generation circuit can output a rectangular wave having desired peak voltages from the first pulse. Moreover, driving that affords a margin relative to magnetic saturation of the transformer can be realized.

Here, if the number of times (the number) of pulses applied to the developing sleeve has not reached a predetermined specified number of times (in the case of the waveform shown in FIG. 3, twice) provided from the upper controller 200 (NO in step S7), the control unit 100 repeats the processing described in steps S5 and S6. Moreover, if the number of times of pulses applied to the developing sleeve has reached the predetermined specified number of times (YES in step S7), the control unit 100 produces a blank period (third control period). Specifically, if the specified number of times of pulses is reached, the control unit 100 provides an ON signal to the gates of the switching elements Q1 and Q3 and also provides an OFF signal to the gates of the switching elements Q2 and Q4 (step S8). That is to say, an electrical connection is established between the switching elements Q1 and Q3 during the blank period tblank. Thus, an output of 0 V is obtained on the secondary winding side of the transformer T1.

The control unit 100 repeatedly executes the above-described operations of the to period, the tb period, and the tblank period until receiving a stop signal of the developing alternating voltage. Thus, asymmetric duty cycle blank pulses are continuously output.

The upper controller 200 outputs a stop signal indicating the stopping of the developing alternating voltage to the control unit 100 when the developing process onto the printing medium P is ended. The control unit 100 determines whether or not a stop signal has been received from the upper controller 200 (step S9). Upon receipt of the stop signal (YES in step S9), the control unit 100 performs control so as to turn off the gates of the switching elements Q2 and Q4 and also turn on the gates of the switching elements Q1 and Q3. Moreover, the control unit 100 keeps the outputs of the transistors Q5 and Q6 at Va and Vb (step S10). This is the same state as the image forming standby state shown in step S3.

Here, the control unit 100 stands by until receiving either the next output signal of the developing, alternating voltage or a standby cancellation signal from the upper controller 200. Upon receipt of any signal during this standby period, the control unit 100 determines what the signal is. If it is determined that the signal is the next output signal of the developing alternating voltage (if an output signal of the developing alternating voltage is received in step S11), the control unit 100 shifts to the operation in step S5 again and executes the above-described operations. Moreover, if the signal is a standby cancellation signal (if a standby cancellation signal is received in step S11), the control unit 100 turns off all of the switching elements Q1 to Q4 and stops controlling the transistors Q5 and Q6 (step S12).

Figure 5:
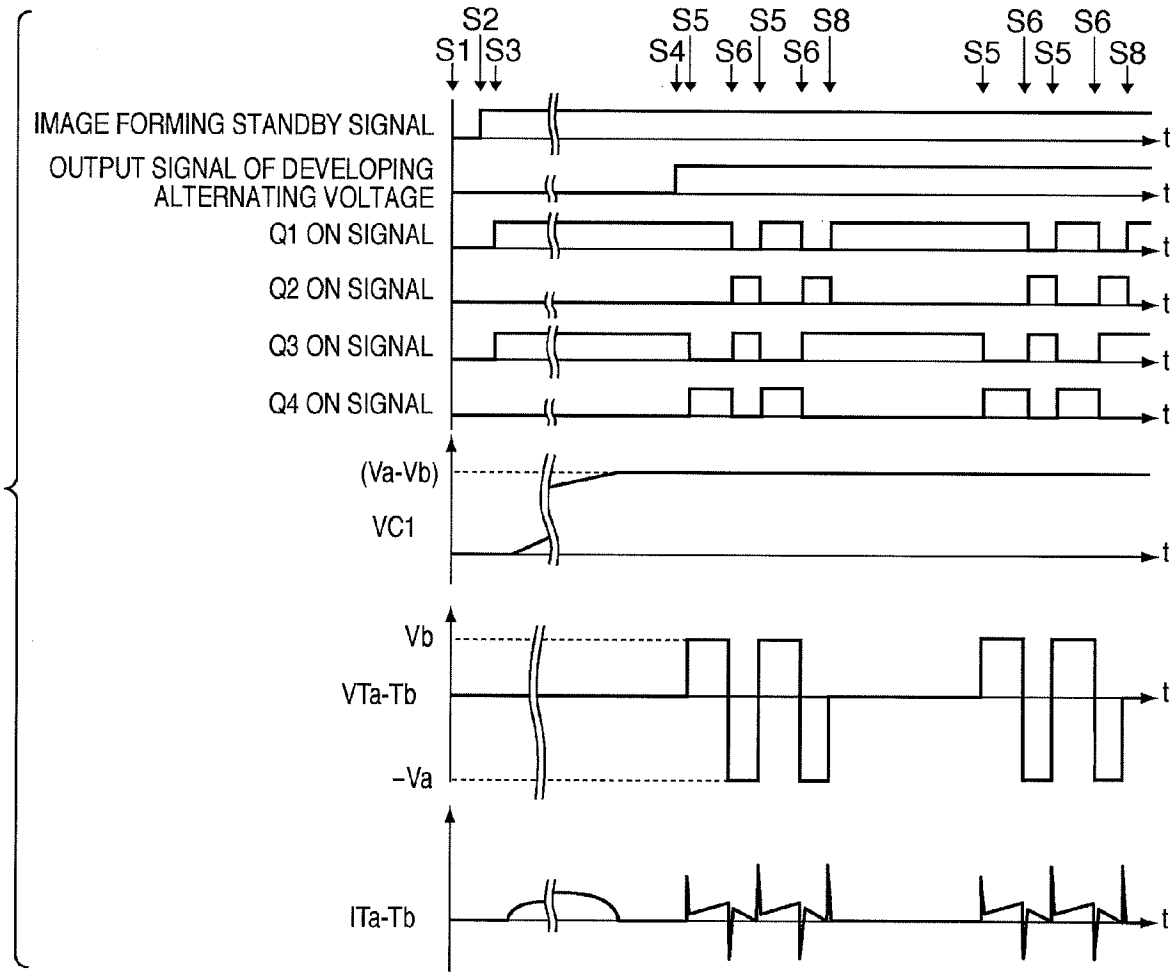
FIG. 5 is a diagram showing an example of an outline of a controlling process by the control unit 100.
Figure 6A:
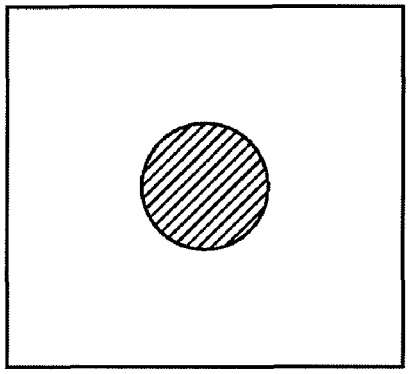
FIGS. 6A and 6B are diagrams showing an example of problems of conventional technologies.
Figure 6B:
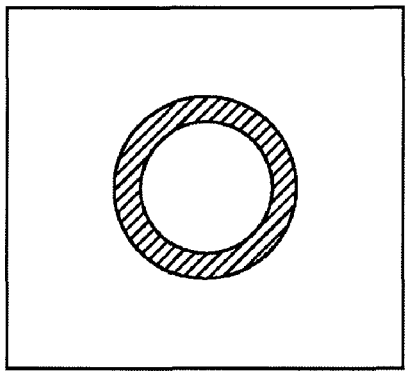
Figure 7:
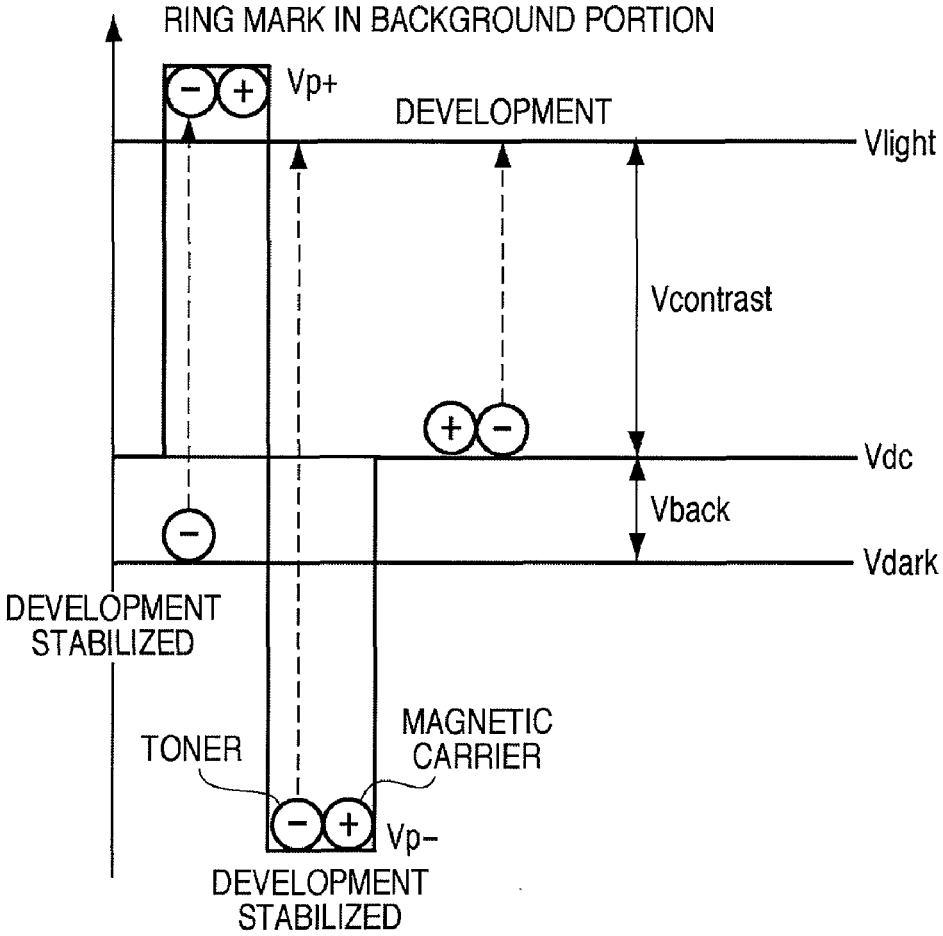
FIG. 7 is a diagram showing an example of the problems of the conventional technologies.
Figure 8:
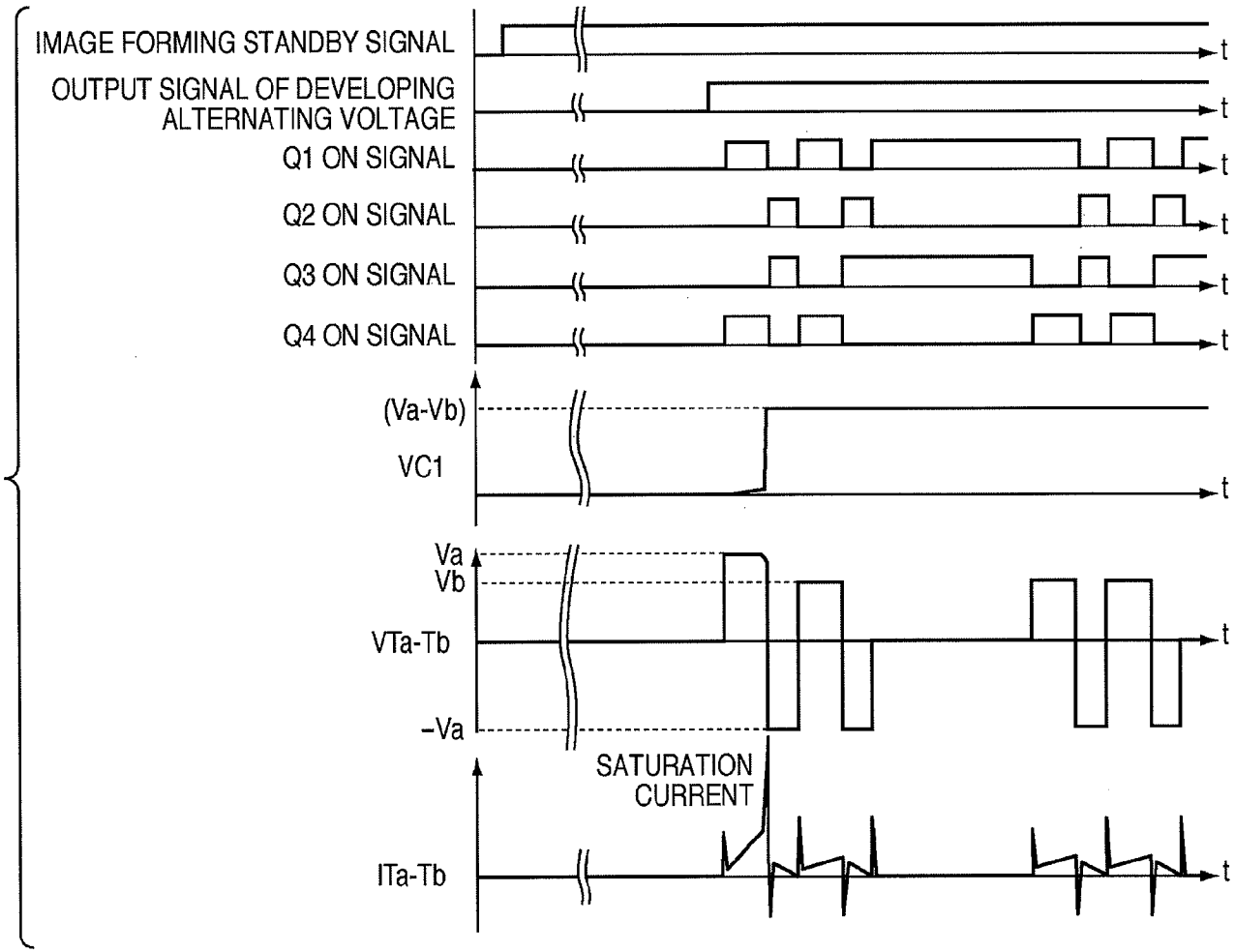
FIG. 8 is a diagram showing an example of the problems of the conventional technologies.

Next, an example of an outline of the controlling process by the control unit 100 described in FIG. 4 will be described using FIGS. 5 and 8. FIG. 5 shows an example of the various control signals (see FIG. 4), the voltage across the capacitor C1 shown in FIG. 2, the voltage across the transformer T1, and output timings of the transformer T1. Here, as a comparative example, FIG. 8 shows an outline of the controlling process in the case without the configuration according to the present embodiment. In FIG. 8, the controller starts to control the transistors Q5 and Q6 upon receiving an image forming standby signal, but makes the switching elements Q1 to Q4 stand by in an OFF state.

$V_{C1}$ is a potential difference across the capacitor C1 and indicates the voltage on one end side of the capacitor C1 relative to the other end that is on the switching element Q4 side. $V_{Ta\text{-}Tb}$ is a potential difference of the primary winding of the transformer T1 and indicates the voltage at the Ta end relative to the Tb end. $I_{Ta-Tb}$ is a current flowing through the primary winding of the transformer T1 from the Ta end to the Tb end. Moreover, the vertical double wavy lines in FIGS. 5 and 8, which represent an omission in the time axis, indicate that the time after the receipt of the image forming standby signal to the completion of storing a predetermined amount of electric charge in the capacitor C1 or to the receipt of an output signal is sufficiently long as compared to an output pulse cycle. Furthermore, S1 to S8 on the upper side in FIG. 5 correspond to processing timings of the respective steps in the flowchart described in FIG. 4. However, steps S2, S4, and S7, which are the determination steps in FIG. 4, correspond to the timings of events that trigger off the determination. Changes in the current at the time when the switching elements are switched on/off, which can be seen in both of FIGS. 5 and 8, are due to charging or discharging currents of the developing device 4, which serves as the load.

Here, a comparison between FIG. 5 and FIG. 8 shows that there is a difference in whether or not an electric charge is stored in the capacitor C1 before starting output of the alternating voltage (i.e., before the receipt of an output signal of the developing alternating voltage). In the case of FIG. 5, the relationship of Vb:Va=V+:|V−|=tb:ta holds. That is to say, since an electric charge of Va−Vb is applied to the capacitor C1, when there is an electrical connection between the switching elements Q1 and Q4 (during the period ta), Va−(Va−Vb)=Vb is obtained as the potential difference across the primary winding of the transformer T1.

Moreover, when there is an electrical connection between the switching elements Q3 and Q2 (during the period tb), Vb−(Vb−Va)=Va is obtained as the potential difference across the primary winding of the transformer T1. In the case shown in FIG. 3, since V+<|V−|, the control unit 100 calculates a value that has the relationships of ta>tb and Vb<Va. At a VT product during the transition from the state in which the switching elements Q1 and Q4 are on and the switching elements Q2 and Q3 are off (see S5 shown in FIG. 5) to the state in which the switching elements Q2 and Q3 are on and the switching elements Q1 and Q4 are off (see S6 shown in FIG. 5), the magnetic flux density reaches a maximum value. This value is Vb×ta (=Vb×tb).

On the other hand, in FIG. 8, the potential of the capacitor C1 is 0 V when starting output of the alternating voltage. Accordingly, when there is an electrical connection between the switching elements Q1 and Q4, a potential difference of Va−ΔVc≈Va (ΔVc is a transient charging voltage of C1) is obtained across the primary winding of the transformer T1. Moreover, when there is an electrical connection between the switching elements Q3 and Q2, a potential difference of Vb−ΔVc≈Vb is obtained across the primary winding of the transformer T1.

That is to say, considering the VT product when starting output of the alternating voltage, the magnetic flux density reaches a maximum value during the transition from the state in which Q1 and Q4 are on and Q2 and Q3 are off (see S5) to the state in which Q2 and Q3 are on and Q1 and Q4 are off (see S6). This value is Va×ta (>Vb×ta=Va×tb). A large VT product, Va×ta, is applied to the transformer, and as shown in FIG. 8, a large current due to magnetic saturation flows through the transformer.

For example, assuming that Vp+:Vp− is an amplitude ratio of 6:4, the VT product in the case of FIG. 5 is Vb×ta=4x×6y=24×xy, where x and y are constants, whereas the VT product in the case of FIG. 8 is Va×ta=6x×6y=36×xy, and therefore, the maximum value of magnetic flux density in the case of FIG. 8 is as much as 1.5 times greater than that in the case of FIG. 5.

Assuming that Vp+:Vp− is an amplitude ratio of 7:3, the maximum value of magnetic flux density in the case of FIG. 8 is 2.3 times greater than that in the case of FIG. 5.

As described above, according to the present embodiment, the maximum value of magnetic flux density of the transformer can be suppressed to a small value, and therefore, a blank pulse waveform having an asymmetric duty cycle can be output even if an inexpensive transformer of low magnetic flux density is used. Accordingly, for example, a cost reduction can be achieved.

Also, the transformer is prevented from being magnetically saturated from the start of output of the alternating voltage, and furthermore, a desired output can be obtained even at any amplitude values, or at any duty cycle or with any blank period.

It should be noted that in the foregoing embodiment, the case where the waveform is a waveform consisting of two pulse cycles and a blank period at 0 V is described as an example; however, this is not a limitation. In the circuit configuration shown in FIG. 2, the number of pulses that can be output may be any number and the voltage during the blank period may be any value other than 0 V as long as an alternating waveform is formed as the sum of a pulse period and a blank period, and even in those cases, the present invention can be carried out.

According to the present invention, the maximum value of magnetic flux density of a transformer can be suppressed to a small value, and therefore, a blank pulse waveform having an asymmetric duty cycle can be output even if an inexpensive transformer of low magnetic flux density is used. Moreover, the transformer can be prevented from being magnetically saturated from the start of output, and furthermore, a desired output can be obtained even at any amplitude values, or at any duty cycle or with any blank period.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2009-172568 filed on Jul. 23, 2009, which is hereby incorporated by reference herein in its entirety.

What is claimed is:

1. An image forming apparatus, comprising:

a developing device configured to perform development by sticking a developer to an electrostatic latent image formed on a surface of an image carrier; and a voltage generation circuit configured to apply a developing bias voltage in which a direct voltage is superimposed on an alternating voltage to the developing device, wherein the voltage generation circuit comprises:

a transformer configured to generate the alternating voltage to be applied as the developing bias voltage on a secondary winding by an effect of a primary winding;

a capacitor that is connected to a first end of the primary winding of the transformer;

a first voltage generating unit that is connected to a second end of the primary winding of the transformer different from the first end and is configured to generate a first voltage;

a second voltage generating unit that is connected to the first end of the primary winding of the transformer via the capacitor and is configured to generate a second voltage having a voltage value different from the first voltage; and a controller configured to perform control so as to store an electric charge in the capacitor with the first voltage and the second voltage before the alternating voltage is generated by the effect of the primary winding of the transformer.

2. The image forming apparatus according to claim 1, further comprising:

a first switching unit that is connected between the first voltage generating unit and the second end of the primary winding of the transformer and is configured to switch a connection with the first voltage generating unit and the second end of the primary winding of the transformer in a connected state or an unconnected state;

a second switching element that is connected between the second end of the primary winding of the transformer and a ground and is configured to switch a connection with the second end of the primary winding of the transformer and a ground in a connected state or an unconnected state;

a third switching unit that is connected between the second voltage generating unit and the capacitor and is configured to switch a connection with the second voltage generating unit and the capacitor in a connected state or an unconnected state; and a fourth switching unit that is connected between the capacitor and the ground and is configured to switch a connection with the capacitor and the ground in a connected state or an unconnected state, wherein the controller stores an electric charge in the capacitor with the first voltage and the second voltage by controlling the first switching unit and the third switching unit to the connected state and controlling the second switching unit and the fourth switching unit to the unconnected state, before the alternating voltage is generated by the effect of the primary winding of the transformer.

3. The image forming apparatus according to claim 2, wherein the controller has:

a first control period during which the first switching unit and the fourth switching unit are controlled to the connected state and the second switching unit and the third switching unit are controlled to the unconnected state after completion of storing a predetermined amount of electric charge in the capacitor; and a second control period during which the second switching unit and the third switching unit are controlled to the connected state and the first switching unit and the fourth switching unit are controlled to the unconnected unit after the first control period has elapsed, and when the alternating voltage is generated by the effect of the primary winding of the transformer, the control of the first control period and the second control period is repeated a predetermined specified number of times.

4. The image forming apparatus according to claim 3, wherein the controller further has a third control period during which the first switching unit and the third switching unit are controlled to the connected state and the second switching unit and the fourth switching unit are controlled to the unconnected state after the second control period has elapsed, and the control of the third control period is performed if the control of the first control period and the second control period is performed the predetermined specified number of times.

5. The image forming apparatus according to claim 3, wherein the secondary winding of the transformer generates a voltage based on the second voltage that is a potential difference between the first end and the second end of the primary winding of the transformer as the alternating voltage during the control of the first control period, and generates a voltage based on the first voltage that is a potential difference between the first end and the second end of the primary winding of the transformer as the alternating voltage during the control of the second control period.

6. The image forming apparatus according to claim 1, wherein a ratio of an absolute value of the first voltage to an absolute value of the second voltage is equal to a ratio of the first control period to the second control period.

7. A voltage generation circuit configured to apply a developing bias voltage in which a direct voltage is superimposed on an alternating voltage to a developing device configured to perform development by sticking a developer to an electrostatic latent image formed on a surface of an image carrier, the circuit comprising:

a transformer configured to generate the alternating voltage to be applied as the developing bias voltage on a second winding by an effect of a primary winding;

a capacitor that is connected to a first end of the primary winding of the transformer;

a first voltage generating unit that is connected to a second end of the primary winding of the transformer different from the first end and is configured to generate a first voltage;

a second voltage generating unit that is connected to the first end of the primary winding of the transformer via the capacitor and is configured to generate a second voltage having a voltage value different from the first voltage; and a controller configured to perform control so as to store an electric charge in the capacitor with the first voltage and the second voltage before the alternating voltage is generated by the effect of the primary winding of the transformer.

* * * * *